US007761034B2

(12) United States Patent
Shishido et al.

(10) Patent No.: US 7,761,034 B2
(45) Date of Patent: Jul. 20, 2010

(54) IMAGE FORMING APPARATUS WITH CLEANING MEANS AND IMAGE FORMING METHOD USING THE SAME

(75) Inventors: Makoto Shishido, Osaka (JP); Shiho Okawa, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 898 days.

(21) Appl. No.: 11/602,014

(22) Filed: Nov. 20, 2006

(65) Prior Publication Data

US 2007/0122189 A1 May 31, 2007

(30) Foreign Application Priority Data

Nov. 28, 2005 (JP) ..... 2005-342034

(51) Int. Cl.
*G03G 21/00* (2006.01)

(52) U.S. Cl. ..... 399/129; 399/128; 399/175

(58) Field of Classification Search ..... 399/128, 399/129, 174, 175, 159, 353, 354
See application file for complete search history.

(56) References Cited

U.S. PATENT DOCUMENTS 5,678,142 A * 10/1997 Saegusa ..... 399/129
6,415,122 B1 * 7/2002 Hara et al. ..... 399/128
2004/0136749 A1 * 7/2004 Kinoshita et al. ..... 399/129
2005/0047830 A1 * 3/2005 Tango et al. ..... 399/175

FOREIGN PATENT DOCUMENTS

JP 06-083249 3/1994

* cited by examiner

*Primary Examiner*—David M Gray
*Assistant Examiner*—G.M. Hyder
(74) *Attorney, Agent, or Firm*—Carmody & Torrance LLP

(57) ABSTRACT

An image forming apparatus capable of reducing white streaks in gray images and an image forming method using the same are provided. The image forming apparatus including a charging means, a developing means, a transferring means, and a discharging means which are arranged in sequence around a monolayer type electrophotographic photoconductor. The charging means is a means for positively charging the surface of the monolayer type electrophotographic photoconductor, and the pre-charging means has a conductive brush composed of a conductive substrate and conductive brush filaments and is arranged between the charging means and the discharging means. The conductive filaments on the surface of the photoconductor have a bending ratio that is calculated so that the conductive brush filament tips are properly curved near the surface of the photoconductor so as to reduce abnormal discharge between the conductive brush and the surface of the photoconductor.

11 Claims, 13 Drawing Sheets

(a)

(b)

IMAGE FORMING APPARATUS WITH CLEANING MEANS AND IMAGE FORMING METHOD USING THE SAME

BACKGROUND OF THE INVENTION

1. Field of the Invention

The present invention relates to an image forming apparatus and an image forming method using the same and, particularly, to an image forming apparatus excellent in the prevention of white streaks in gray images even if a conductive brush is used as a pre-charging means.

2. Related Art

Conventionally, image forming apparatuses used in such as printers and copy machines used an image forming process, in which a charging means for charging the electrophotographic photoconductor, an exposure means for exposing the charged the surface of the photoconductor to form an latent image, a developing means for transferring toner to the latent image to develop it, a transferring means for transferring the toner to a recording paper to produce an image, and a discharging means for removing residual potential on the surface of the photoconductor after the transfer are arranged around the photoconductor.

In such an image forming process further, the reversal development technique in which a charge opposite to that of the surface of the photoconductor is applied for transferring the toner image to a recording paper is used. The reversal development technique sometimes leads to so-called transfer memory on the surface of the photoconductor after the transfer, which is a residual potential of a charge opposite to that of the surface of the photoconductor.

Although the transfer memory is removed by the subsequent discharging means, a small quantity of transfer memory that is not completely removed by the discharging means accumulates inside the photoconductor after repeated use, causing deterioration in image properties.

On the other hand, when a contact charging system is used as the charging means, the entire constitution is simplified in comparison with a non-contact charging system and no harmful substances such as ozone generate, which has a properties of a tolerance for environments, while a wide charge saturation range is not obtained. Therefore, it is difficult to use a contact charging system to a monolayer type electrophotographic photoconductor excellent in the productivity.

In order to solve the above problems, as shown in FIG. 13, an image forming apparatus 100 using the reversal development system comprising a primary contact charging roller 102, a developing means 104, a transferring means 106, and a pre-exposure lamp 109 has been proposed, in which a contact pre-charging roller 108 that is charged to the same polarity as the charging roller 102 is arranged upstream of the charging roller 102 so that the surface of the photoconductor charged opposite to that of the contact primary charging roller is boosted to the same polarity to remove the transfer memory (for example, see Patent Document 1).

[Patent Document 1] JP-H6-83249A (Claims and FIG. 1)

SUMMARY OF THE INVENTION

Problems to be Solved

However, in the image forming apparatus according to Patent Document 1, the charging conditions of the pre-charging roller are not so fully considered that, for example, the pre-charging roller may fail to supply a sufficient amount of electric current to the surface of the photoconductor and, may not completely remove the transfer memory, when the pre-charging roller is subject to changes in shape or material.

When an increased amount of electric current is applied by the pre-charging roller to the surface of the photoconductor in order to remove the transfer memory, abnormal discharge generates due to uneven contact between the pre-charging roller and the surface of the photoconductor, causing deteriorations in image properties. Particularly, when a conductive brush is used as the pre-charging roller, the conductive brush filaments of the conductive brush and the surface of the photoconductor do not make stable contact, and white streaks appear in the image when a gray image is printed.

Therefore, as a result of intensive investigation by present inventors, present inventors have found out that, in a conductive brush for removing the transfer memory arranged around a photoconductor, the conductive brush may be provided in a position where the conductive substrate and the surface of the photoconductor satisfy a predetermined positional relationship so as to prevent abnormal discharge from generating between the conductive brush filaments and the surface of the photoconductor and, accordingly, to reduce white streaks in gray images, and completed the present invention.

The objective of the present invention is to provide an image forming apparatus, wherein even if a conductive brush is used as a pre-charging member for a positively charged monolayer type electrophotographic photoconductor, the bending ratio (penetration ratio) of the conductive brush filaments on the surface of the photoconductor is defined within a predetermined range to regulate the curvature of the conductive brush filaments at their tips, thereby reducing white streaks in gray images, and an image forming method using the image forming apparatus.

Another objective of the present invention is to provide an image forming apparatus, wherein even if a conductive brush is used as a pre-charging member for a positively charged monolayer type electrophotographic photoconductor, a conductive brush with conductive brush filaments having single filament fineness within a predetermined range is used to reduce white streaks in gray images, and an image forming method using the image forming apparatus.

Another objective of the present invention is to provide an image forming apparatus, wherein even if a conductive brush is used as a pre-charging member for a positively charged monolayer type electrophotographic photoconductor, a conductive brush having a filament density within a predetermined range is used to reduce white streaks in gray images, and an image forming method using the image forming apparatus.

The Means for Solving the Problem

The present invention provides an image forming apparatus including a charging means, a developing means, a transferring means, and a discharging means which are arranged in sequence around a monolayer type electrophotographic photoconductor, wherein;

the charging means is the means for positively charging the surface of the monolayer type electrophotographic photoconductor, a pre-charging means having a conductive brush composed of a conductive substrate and conductive brush filaments is arranged between the charging means and the discharging means, and the bending ratio (K) of the conductive brush filaments on the surface of the photoconductor satisfies the following relational expression (1) in which a (mm) is the minimum distance between the conductive substrate and the surface of the monolayer type electrophotographic photoconductor and b (mm) is the filament length of the conductive brush filaments, whereby the above-mentioned problems are solved.

$$\text{Bending ratio } (K)=(b-a)/b \leqq 0.3 \quad (1)$$

When the conductive brush is arranged around the photoconductor in the manner that the conductive substrate and the surface of the photoconductor satisfy the above relational expression (1), the conductive brush filament tips are properly curved near the surface of the photoconductor so as to reduce abnormal discharge between the conductive brush and the surface of the photoconductor. Therefore, white streaks in gray images may be reduced as a result of this abnormal discharge.

FIG. 1 shows actual white streaks appearing in a gray image. It is understood that the white streaks observed like this, undulate corresponding to the thrust (reciprocal movement) of the conductive brush in the axial direction of the photoconductor and, therefore, are caused by the conductive brush.

In another aspect of the present invention, an image forming apparatus, wherein;

a pre-charging means having a conductive brush is arranged between the charging means and the discharging means, and the conductive brush has conductive brush filaments having a single filament fineness of 6 (denier) (≈0.66 (g/km)) or above is provided.

In such an image forming apparatus, when a conductive brush is used as the pre-charging member for a positively charged monolayer type electrophotographic photoconductor, a conductive brush with conductive brush filaments having single filament fineness within a predetermined range is used to prevent abnormal discharge around the contact area between the conductive brush and the surface of the photoconductor, reducing white streaks in gray images caused by the abnormal discharge.

In yet another aspect of the present invention, an image forming apparatus, wherein;

a pre-charging means having a conductive brush is arranged between the charging means and the discharging means, the conductive brush is in contact with the surface of the monolayer type electrophotographic photoconductor, and the conductive brush having a filament density of 180 (kilo-filaments/inch$^2$) (≈2.28 kilo-filaments/cm$^2$) or below is provided.

In such an image forming apparatus, when a conductive brush is used as the pre-charging member for a positively charged monolayer type electrophotographic photoconductor, a conductive brush having a filament density within a predetermined range is used to prevent abnormal discharge around the contact area between the conductive brush and the surface of the photoconductor, reducing white streaks in gray images caused by the abnormal discharge.

It is preferable in the constitution of the present invention that the difference (b−a) between the conductive brush filament length b (mm) and the minimum distance a (mm) be set to a value within the range of 0.01 to 1.0 (mm).

Due to such a constitution, the distance between the conductive brush and the surface of the photoconductor may be defined as an absolute value, enabling the curvature of the brush filament tips to be uniformly controlled in comparison with the case of being defined as a relative value.

It is also preferable in the constitution of the present invention that conductive brush filaments be made of a polyamide resin or a polyester resin containing conductive particles.

Due to such constitution, the conductive brush filaments are appropriately soft, realizing more uniform contact with the surface of the photoconductor and reducing the wear on the surface of the photoconductor, extending the operating lifetime.

It is also preferable in the constitution of the present invention that the conductive brush filaments have the an original filament resistance set to a value of $1\times10^{11}$ (Ω·cm) or below.

Due to such a constitution, the charging voltage applied to the conductive brush may be reduced to a predetermined range, effectively preventing abnormal discharge around the contact area between the conductive brush and the surface of the photoconductor and effectively removing the transfer memory.

It is also preferable in the constitution of the present invention that the conductive brush filaments be woven into a conductive fabric and the brush filaments-woven conductive fabric is attached to a conductive substrate.

Due to such a constitution, the conductive brush filaments are easily maintained in a uniformly oriented state, reducing uneven contact among the conductive brush filaments, effectively preventing abnormal discharge around the contact area between the conductive brush and the surface of the photoconductor.

It is also preferable in the constitution of the present invention that the conductive substrate be a stainless plate.

Due to such a constitution, a highly conductive and mechanically strong conductive brush may be obtained. A material having certain strength such as a stainless plate allows the minimum distance a (mm) between the conductive substrate and the surface of the photoconductor to be accurately defined, effectively reducing white streaks.

It is also preferable in the constitution of the present invention that the charging means be a contact charging means.

Due to such a constitution, a simply structured and environmentally friendly image forming apparatus may be obtained.

It is also preferable in the constitution of the present invention that the initial charging voltage of the charging means to the monolayer type electronic photoconductor be set to a value of 400 (V) or above.

Due to such a constitution, the pre-charging means removes the transfer memory and may obtain excellent discharging effect while desired image properties are maintained.

In yet another aspect, the present invention provides an image forming method using an image forming apparatus including a charging means, a developing means, a transferring means, and a discharging means which are arranged in sequence around a monolayer type electrophotographic photoconductor, wherein;

the monolayer type electrophotographic photoconductor is positively charged by the charging means, a pre-charging means has a conductive brush having a conductive substrate and conductive brush filaments is arranged between the charging means and the discharging means, and the bending ratio (K) of the conductive brush filaments on the surface of the photoconductor satisfies the following relational expression (1) in which a (mm) is the distance between the conductive substrate and the monolayer type electrophotographic surface of the photoconductor and b (mm) is the filament length of the conductive brush filaments.

$$\text{Bending ratio } (K)=(b-a)/b \leqq 0.3 \quad (1)$$

DETAILED DESCRIPTION OF THE INVENTION

First Embodiment

The first embodiment of the image forming apparatus of the present invention is described hereinafter with reference to the drawings.

1. Basic Constitution

Figure 1:
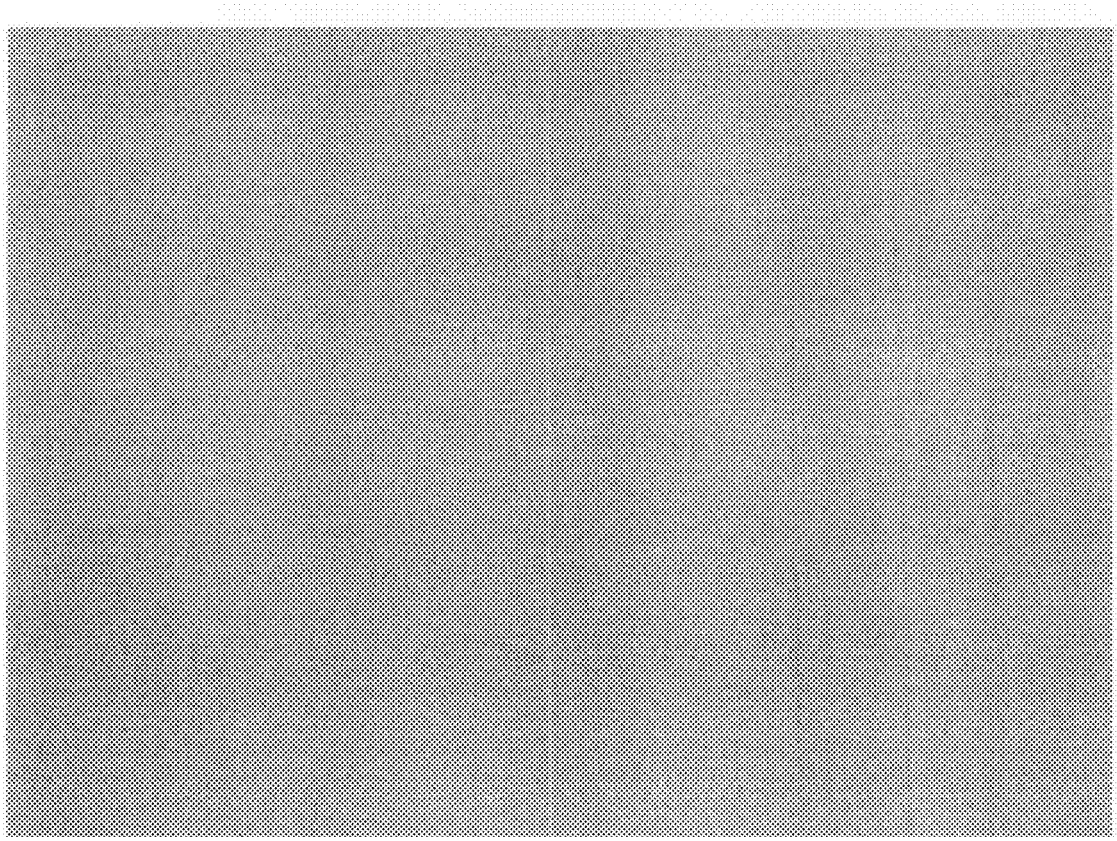
FIG. 1 is an image for showing the white streaks in a gray image.
Figure 2:
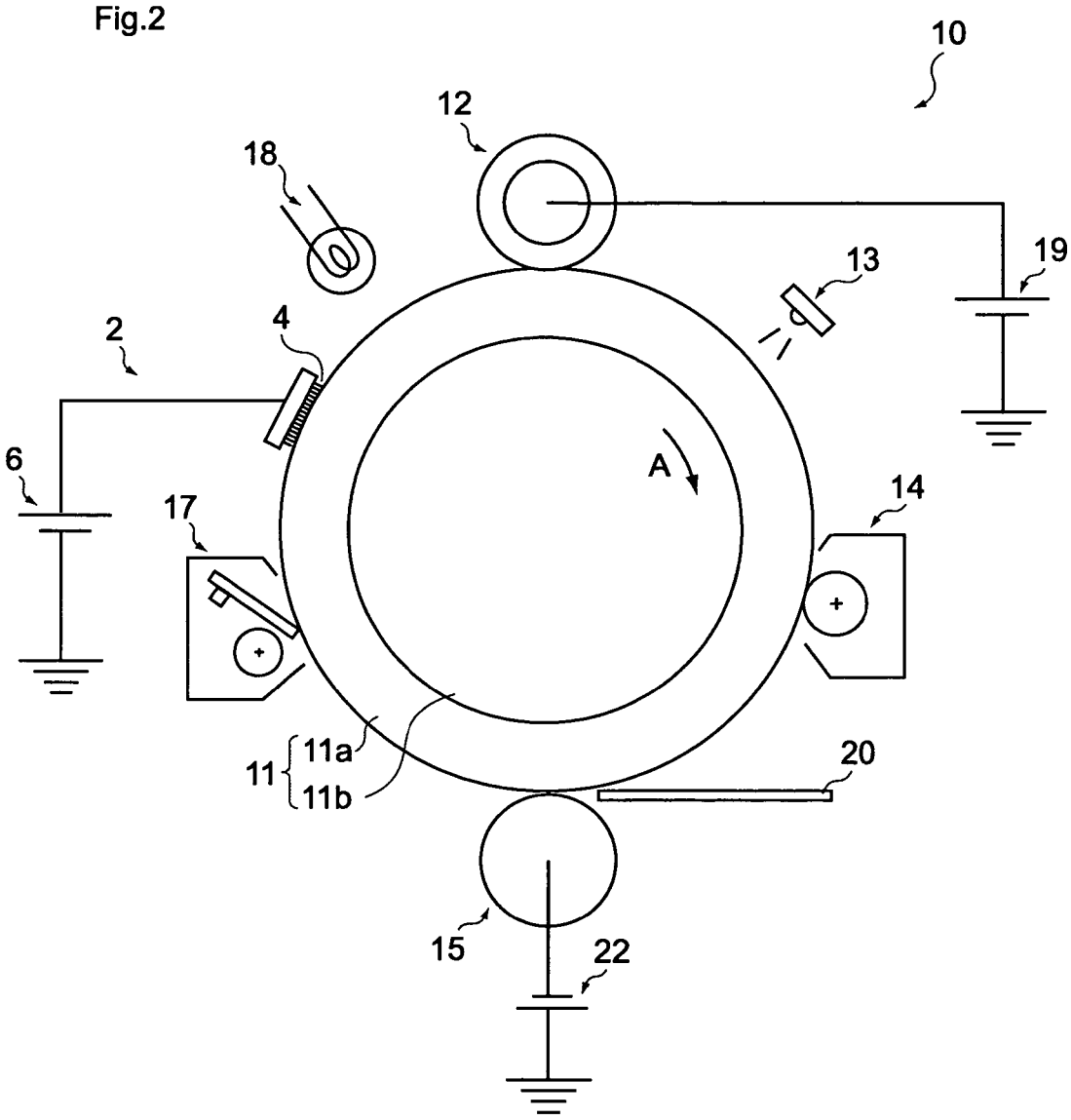
FIG. 2 is a schematic illustration for showing the image forming apparatus of the present invention.

FIG. 2 shows the basic constitution of the image forming apparatus of the present invention. An image forming apparatus 10 includes a drum-shaped monolayer type electrophotographic photoconductor (sometimes termed "the photoconductor" hereinafter) 11. In the rotation direction indicated by an arrow A, a charging means 12, an exposure means 13 for forming a latent image on the surface of the photoconductor, a developing means 14 for applying toner to the surface of the photoconductor to develop the latent image, a transferring means 15 for transferring the toner to a recording paper 20, a cleaning device 17 for removing residual toner on the surface of the photoconductor, a pre-charging means 2 for removing a transfer memory generated by the transferring means, and a discharging means 18 for removing residual potential on the surface of the photoconductor are arranged around the photoconductor 11 sequentially.

A power source 19 for applying a charging voltage is connected to the charging means 12. The power source 19 may supply only direct current (DC) components or overlapped voltages created by overlapping alternate current (AC) components with DC components. The power source 19 may be connected to the charging means 12 at the positive terminal so that the image forming apparatus is a positively-charged type.

A power source 22 is connected to the transferring means 15. The power source 22 supplies direct current (DC) components and is connected to the transferring means at the negative terminal. With this connection, the image forming apparatus is a reversal development type.

In the reversal development system, when the positively charged surface of the photoconductor is reversely charged, the negatively charged transfer memory is generated on the surface. This transfer memory is subsequently removed by the discharging means 18. If it is not completely removed by the discharging means, the transfer memory interferes with uniform charging of the charging means 12 and uneven charges cause deterioration in image properties.

2. Pre-Charging Means (1) Basic Constitution

The pre-charging means 2 for removing the transfer memory is described here. As shown in FIG. 2, the pre-charging means 2 has a conductive brush 4 that makes direct contact with the surface of the photoconductor 11 and a power source 6 for applying a predetermined voltage to the conductive brush. The power source 6 is connected to the conductive brush 4 at the positive terminal so that the conductive brush 4 is charged opposite to the charge of the transferring means 15.

The power source 6 may supply only direct current (DC) components or overlapped voltages generated by overlapping alternate current (AC) components with DC components so that the charge saturation range is extended for stable charging properties according to the arrangement of the pre-charging means 2.

The conductive brush 4 primarily composes of a conductive substrate 34 electrically connected to the power source 6 and conductive brush filaments 31 attached to the conductive substrate 34. The conductive substrate 34 serves as a plate electrode for the conductive brush 4. The conductive brush filaments 31 serve as conductive wires to establish electric connection between the conductive substrate 34 and the surface of the photoconductor 11.

(2) Positional Relationship to the Photoconductor

The positional relationship of the conductive brush 4 used in the present invention to the photoconductor 11 is described here.

Figure 3:
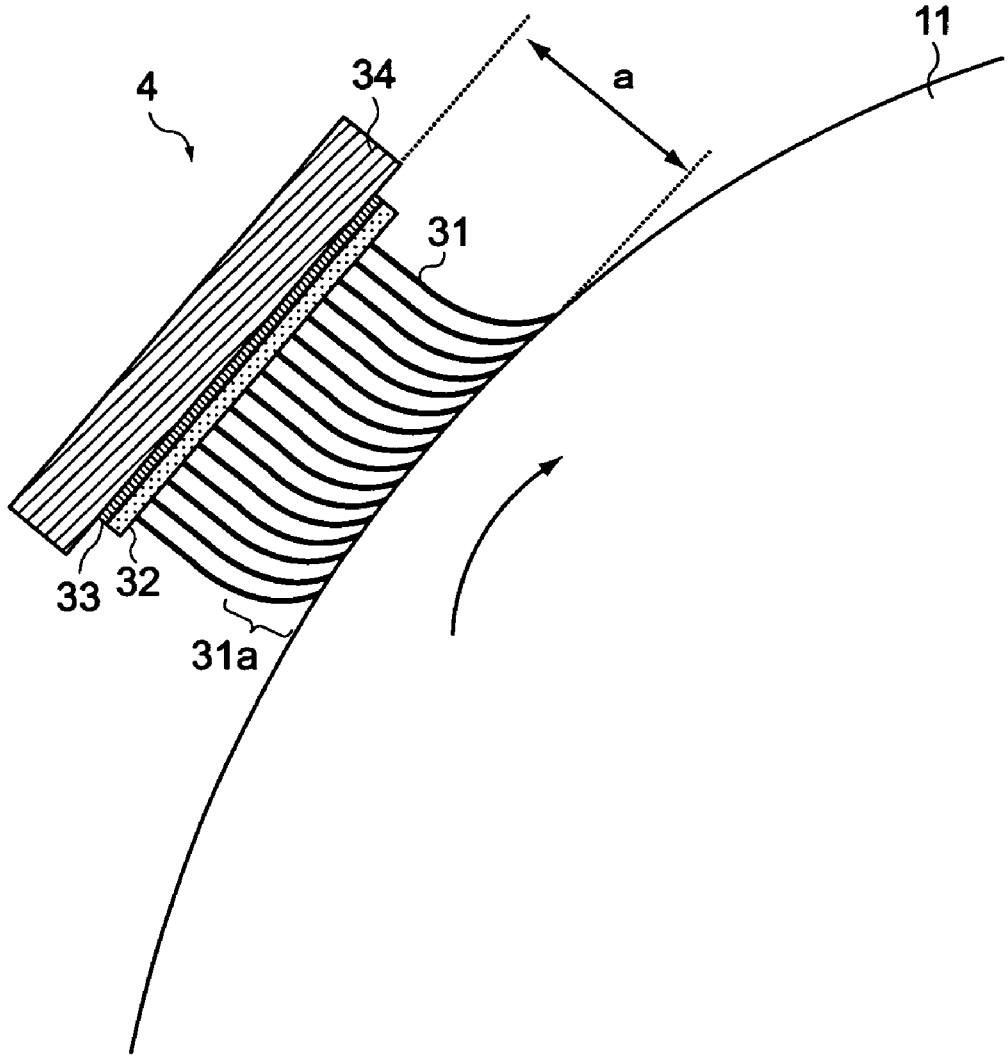
FIG. 3 is an enlarged cross-sectional view for showing the contact between the conductive brush and the photoconductor.

FIG. 3 is an enlarged cross-sectional view of the area near the contact area with the conductive brush 4 and the photoconductor 11. As seen from this figure, the conductive brush 4 is in contact with the surface of the photoconductor 11 via the conductive brush filaments 31. The tips of the conductive brush filaments 31 are curved to follow the rotation of the photoconductor 11. In this manner, the conductive brush filaments 31 and photoconductor 11 are electrically connected with a predetermined contact resistance being maintained, serving as a charging means.

In order to determine the curving of the tips of the conductive brush filaments 31 of the conductive brush 4 positioned as described above, the bending ratio (K) of the conductive brush filaments on the surface of the photoconductor is defined by the relational expression (1) in which a (mm) is the minimum distance between the conductive substrate 34 and the photoconductor 11 and b (mm) is the filament length of the conductive brush filaments.

Figure 4:
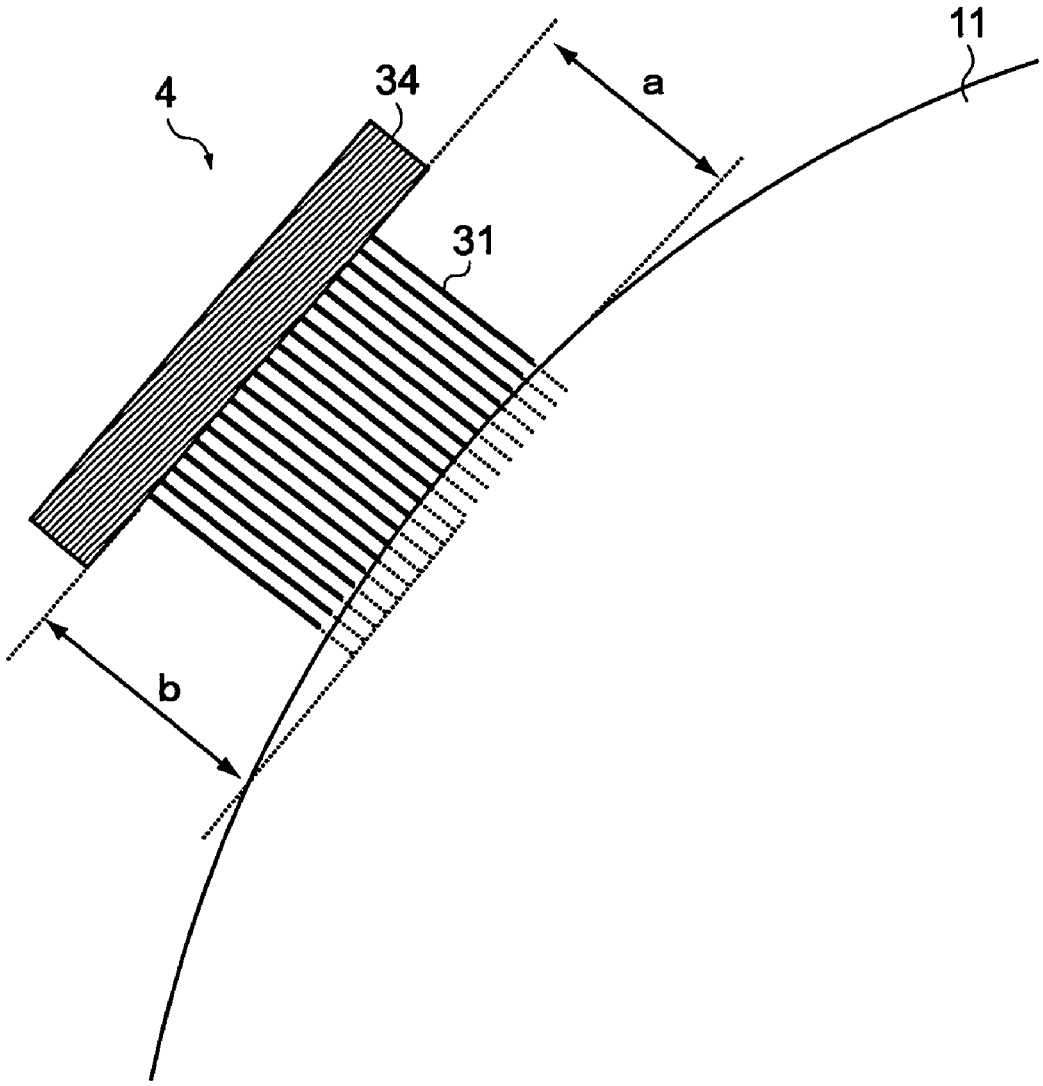
FIG. 4 is an enlarged cross-sectional view for showing the bending ratio.

In the relational expression (1), assuming that the tips of the conductive brush filaments 31 bend on the surface of the photoconductor 11 as shown in FIG. 4, it is understood that (b−a) represents the extent to which they bend on the surface of the photoconductor 11 (termed "the bending quantity" hereinafter).

Therefore, it is understood that the relational expression (1) indicates the ratio of the bending quantity (b−a) (mm) to the filament length b (mm) of the conductive brush filaments 31.

The present invention is characterized in that the conductive brush and photoconductor are positioned with the above defined bending ratio (K) being 0.3 or below.

This is because, due to the bending ratio (K) being defined within a predetermined range, the curving of the conductive brush filaments 31 near the surface of the photoconductor 11 is determined as shown in FIG. 3, thereby reducing abnormal discharge between the conductive brush filaments 31 and the photoconductor 11.

The relationship between the bending ratio (K) and an image property is described hereinafter with reference to FIG. 5.

Figure 5:
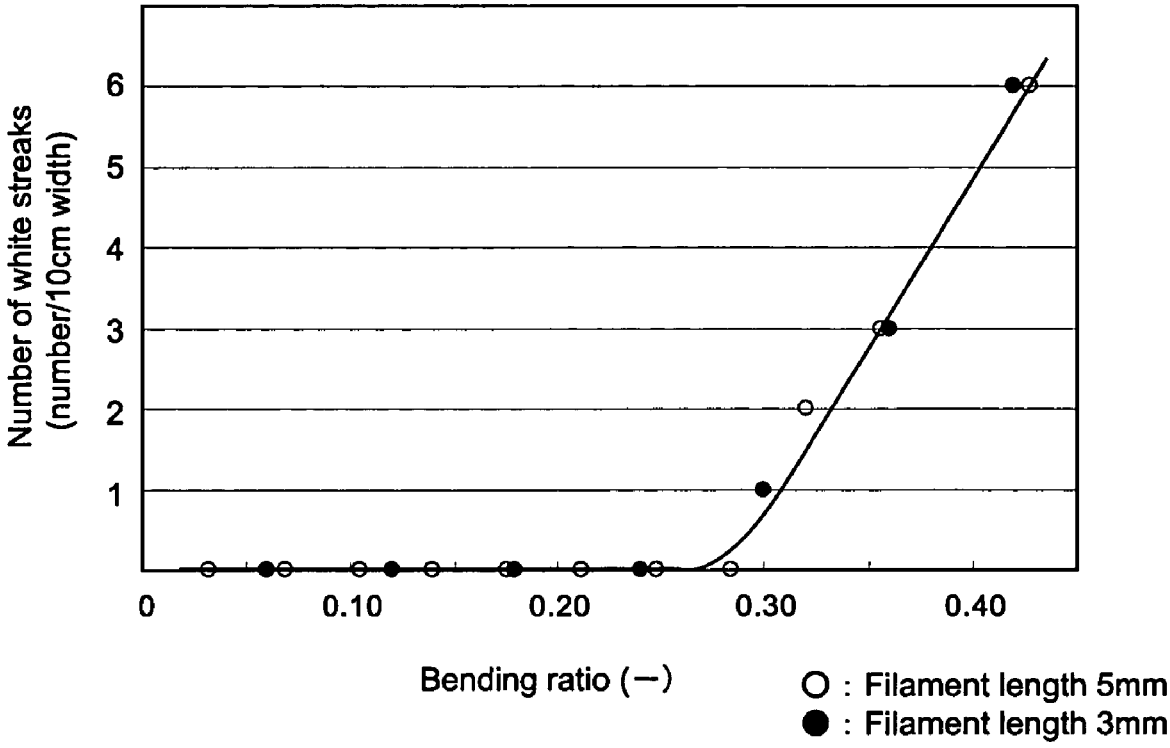
FIG. 5 is a characteristic graph for showing the relationship between the bending ratio and the number of appeared white streaks.

FIG. 5 is a characteristic graph for showing the relationship between the bending ratio (K) of the conductive brush filaments and the quality of an image created using such conductive brush filaments.

In the figure, the bending ratio (K) is plotted as abscissa and the number of white streaks appearing in a gray image as an index of image qualities is plotted as ordinate. Open circles and filled circles represent the outcomes using conductive brush filaments having filament lengths of 5 (mm) and 3 (mm), respectively.

As seen from the figure, the number of white streaks is decreased and, therefore, the image quality is improved as the bending ratio (K) is lowered.

Figure 6:
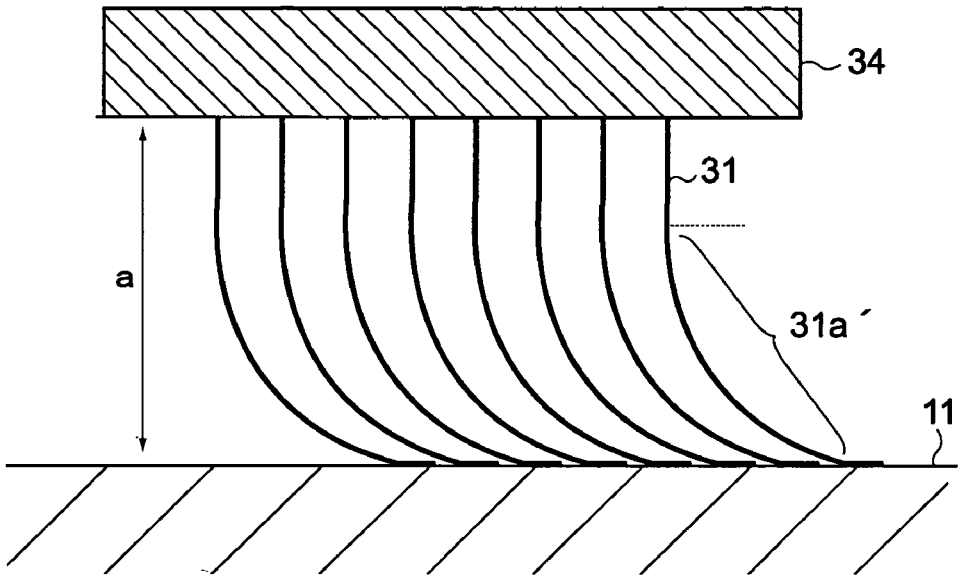
FIGS. 6(*a*) and (*b*) are schematic illustrations for showing the curving of the conductive brush filament tips.
Figure 6:
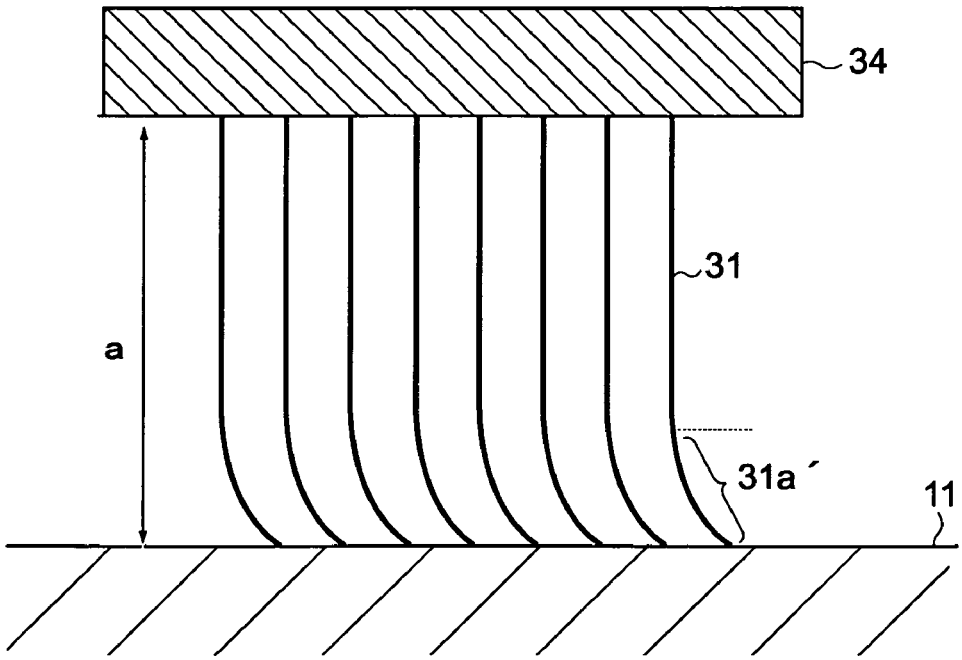

When the bending ratio (K) is increased, as shown in FIG. 6 (*a*), the curved portion 31*a*' within the curving of the conductive brush filaments that is not in direct contact with the photoconductor 11 is increased, resulting in increased abnormal discharge between the conductive brush filaments 31 and the photoconductor 11. Conversely, as shown in FIG. 6(*b*), when the bending ratio (K) is excessively small, some of the tips may not make contact depending on the processing accuracy of the conductive brush filaments, causing an insufficient charging effect.

Therefore the bending ratio (K) is preferably set to a value within a range of 0.05 to 0.25 and more preferably set to a value within a range from 0.1 to 0.2.

Further, the difference (b−a) between the conductive brush filament length b (mm) and the minimum distance a (mm) is preferably set to a value within the range of 0.01 to 1.0 (mm).

This is because, as described above, with the bending quantity (b−a) (mm) being in a predetermined range, the curving of the curved portion 31*a* in FIG. 3 is uniformly determined, effectively reducing abnormal discharge.

For determining curvature, with the bending quantity as an absolute quantity being defined in addition to the above defined bending ratio, the curvature may be controlled within a predetermined range even if the conductive brush filaments are excessively long.

The conductive brush filaments 31 is preferably set a filament length b (mm) to a value within the range of 2 to 7 (mm).

This is because with the filament length within a range of 2 to 7 (mm), the curvature of the conductive brush filaments is determined within a predetermined range when they make contact with the surface of the photoconductor, thereby effectively reducing abnormal discharge between the conductive brush and the photoconductor.

When the filament length falls short of 2 (mm), no contact regions may be created at the conductive brush tip depending on the drum diameter of the photoconductor, thereby causing abnormal discharge. Conversely, when the filament length exceeds 7 (mm), the curved portion of the conductive brush filaments becomes excessively large, also causing abnormal discharge.

Therefore, the filament length of the conductive brush filaments is preferably set to a value within the range of 3 to 6 (mm) and more preferably set to a value within the range of 4 to 5 (mm).

(3) Material

The material of the conductive brush filaments composed of the conductive brush in the present invention is not particularly restricted as long as it is capable of charging the surface of the photoconductor. The material is preferably a polyamide resin or a polyester resin containing conductive particles.

This is because the conductive brush filaments having the above composition has proper softness, which provides more uniform contact with the surface of the photoconductor and less abrasive to the surface of the photoconductor, extending its life.

Furthermore, in adjusting the original filament resistance of the conductive brush filaments, conductivity may easily be changed by adjusting the addition ratio of conductive particles such as carbon.

In determining the thickness of the conductive brush filaments composing the conductive brush, the bush preferably has a single filament fineness of 6 (denier) or above.

This is because the above values allow the conductive brush filaments and photoconductor to make contact in a predetermined contact area or larger, thereby effectively preventing abnormal discharge. Furthermore, the single filament resistance of the brush filaments may be controlled using the single filament fineness of the above values, accurately controlling the resistance of the brush filaments.

The relationship between the single filament fineness of the conductive brush filaments constituting the conductive brush and the number of white streaks appearing in a gray image is described hereinafter with reference to FIG. 7.

Figure 7:
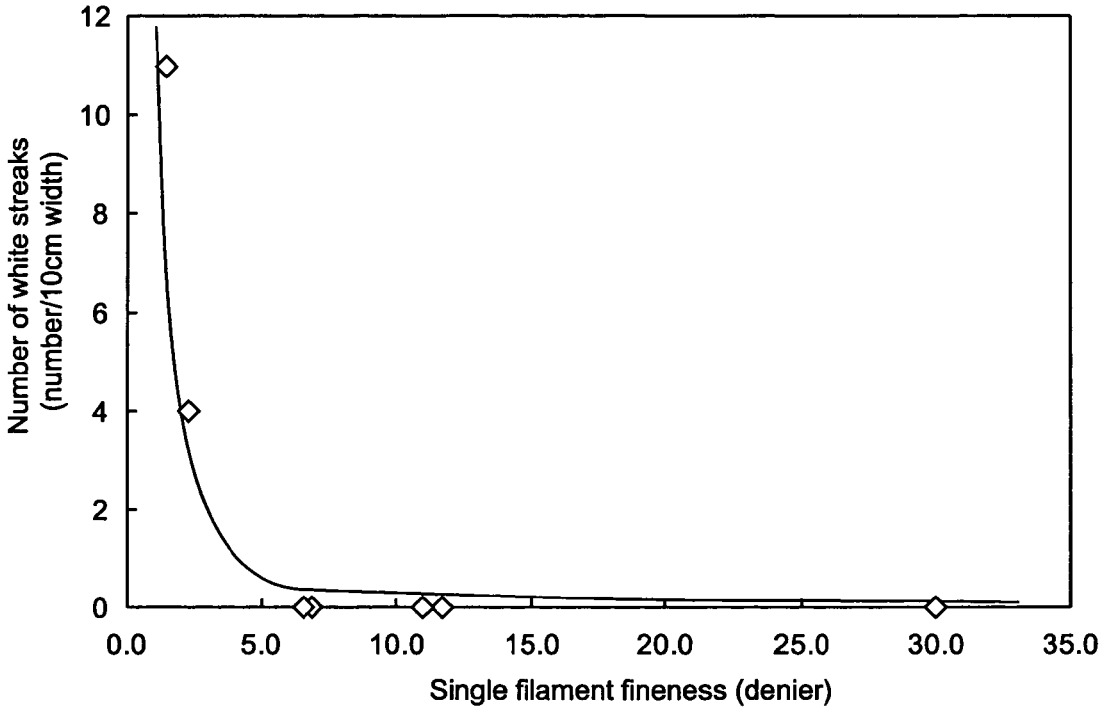
FIG. 7 is a characteristic graph for showing the relationship between the single filament fineness (denier) of the conductive brush filaments and the number of white streaks appearing in a gray image.

FIG. 7 shows a characteristic curve with the single filament fineness of the conductive brush filaments as abscissa and the number of white streaks per 10 cm in the axial direction of the photoconductor as ordinate. As seen from the characteristic curve, a large number of white streaks appear when the single filament fineness is nearly 0 (denier). On the other hand, the number of white streaks is steeply decreased as the single filament fineness is increased from 0 (denier). Specifically, when the single filament fineness is 6 (denier) or above, the number of white streaks may be nearly 0.

Consequently, the single filament fineness is preferably set to a value within the range of 8 to 30 (denier) and more preferably within the range of 10 to 25 (denier).

Furthermore, the filament density of the conductive brush filaments of the conductive brush is preferably set to a value of 180 kF/inch$^2$ (≈28 kF/cm$^2$) or below.

This is because with the above values, mutual contact among the conduct brush filaments may be regulated to prevent abnormal discharge due to uneven mutual contact among the conductive brush filaments.

The relationship between the filament density of the conductive brush and the number of white streaks appearing in a gray image is described hereinafter with reference to FIG. 8.

Figure 8:
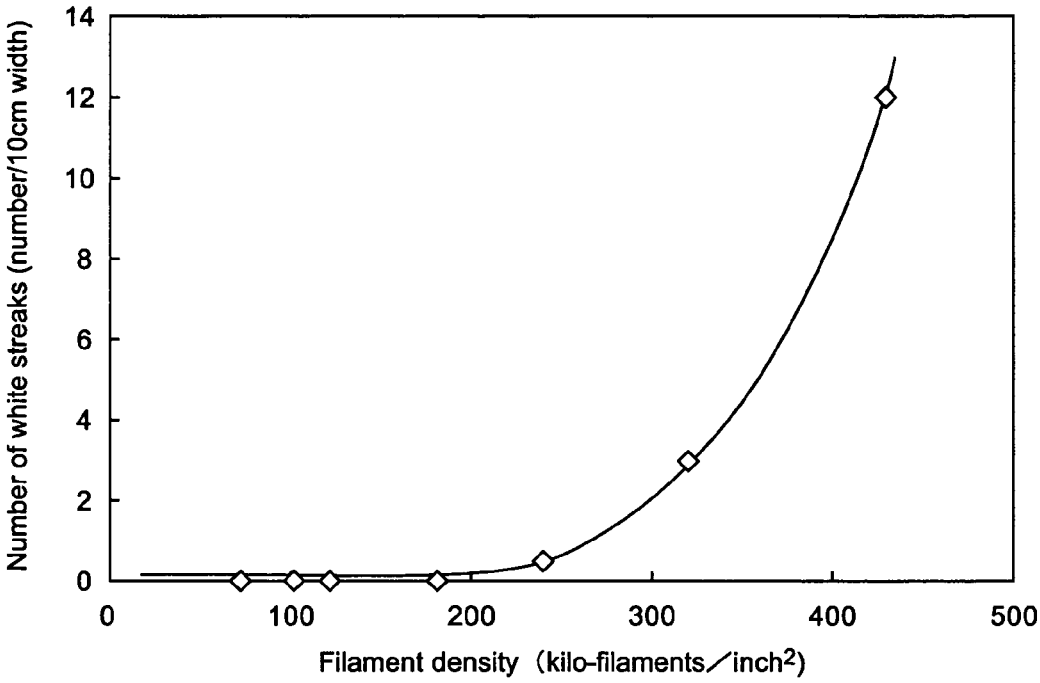
FIG. 8 is a characteristic graph for showing the relationship between the filament density (kilo-filaments/inch$^2$) of the conductive brush filaments and the number of white streaks appearing in a gray image.

FIG. 8 shows a characteristic curve with the filament density of the conductive brush as abscissa and the number of white streaks per 10 (cm) in the axial direction of the photoconductor as ordinate. As seen from the characteristic curve, almost no white streaks appear when the filament density is nearly 0 (kilo-filaments/inch$^2$). On the other hand, the number of white streaks is increased as the filament density is increased from 0 (kilo-filaments/inch$^2$). Specifically, when the filament density is 180 (kilo-filaments/inch$^2$) or below, the number of white streaks may be nearly 0. On the other hand, when the filament density exceeds 180 (kilo-filaments/inch$^2$), the number of white streaks is steeply increased.

Consequently, the filament density is preferably set to a value within the range of 50 to 150 (kilo-filaments/inch$^2$) and more preferably within the range of 70 to 120 (kilo-filaments/inch$^2$).

As shown in FIG. 3, it is preferable that the conductive brush filaments 31 be woven into a conductive fabric 32 made of conductive fiber.

This is because the conductive brush filaments 31 may be uniform in density and orientation when the conductive brush 4 is formed by weaving the conductive brush filaments 31 into the conductive fabric 32, thereby further effectively preventing abnormal discharge as a result of uneven contact among the conductive brush filaments.

(4) Conductive Substrate

The conductive substrate according to the present invention is not particularly restricted as long as it is conductive and has sufficient mechanical strength. The conductive substrate is preferably a metal plate such as stainless, copper, and aluminum. Among these, stainless is particularly preferable.

This is because a stainless plate has particularly excellent conductivity and mechanical strength and, therefore, prevents the conductive brush from becoming deformed and assuring uniform and efficient pre-charging.

The method for attaching the conductive brush filaments to the conductive substrate is not particularly restricted as long as it allows them to be firmly attached to each other while maintaining mutual conductivity. For example, as shown in FIG. 3, a double-faced conductive tape containing a conductive resin composition or a conductive adhesive 33 is preferably used.

This is because the use of a double-faced conductive tape containing a conductive resin composition or a conductive adhesive 33 allows the conductive substrate 34 and conductive brush 31 to be firmly bonded with no practical problems while exhibiting excellent conductivity. Furthermore, the conductive substrate 34 and conductive brush filaments 31 are significantly easily attached to each other, improving production efficiency.

(5) Shape

The conductive brush may be in the form of a rod, or a cylinder having a rotation mechanism. Alternatively, the conductive brush may be curved along the curvature of the surface of the photoconductor. The shape may be selected as appropriate according to a desired charging property.

(6) Mobility and Detachability

The conductive brush is preferably movable, because the pressure between the conductive member and the surface of the photoconductor may be adjusted by moving the conductive brush in a radial direction of the electrophotographic photoconductor, facilitating control of the charging property.

The pressure applied to the surface of the photoconductor by the conductive member is preferably in the range from 0.1 to 100 (kgf/cm$^2$).

It is preferable that the conductive brush be detachable so that the member may be easily replaced. Furthermore, it is easy to make predeterminedation changes, for example, for relatively minor transfer memory in the case that limited voltage is applied to the transferring means or that the photoconductor is a multilayer type photoconductor.

3. Charging Property

In the pre-charging means 2, the power source 6 is used to apply a predetermined voltage to the conductive member 4 to remove a transfer memory produced by the transferring means.

Here, the applied voltage of the pre-charging means 2 is determined so that a current having a current density ($I_b$) of 700 (μA/m$^2$) or above flows from the conductive member 4 to the photoconductive body 11.

Figure 9:
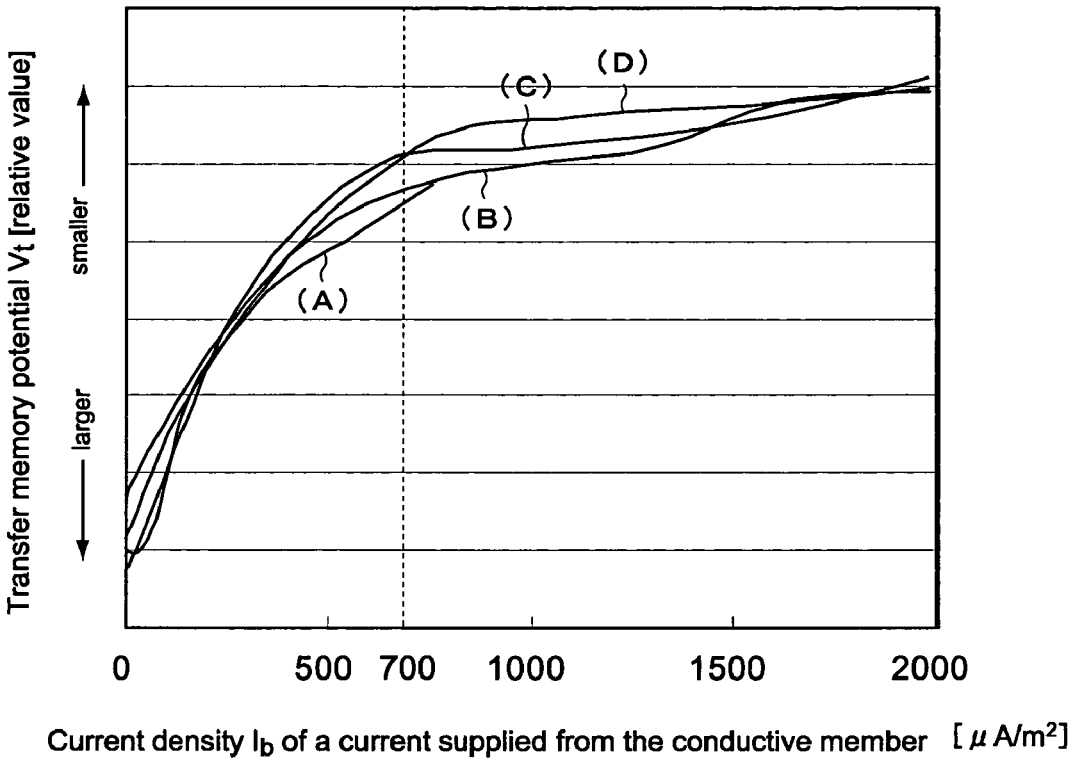
FIG. 9 is a characteristic graph for showing the relationship between the current density ($I_b$) of a current from the conducive member to the surface of the photoconductor and the transfer memory potential ($V_t$).

FIG. 9 is a characteristics graph for showing the relationship between the current density ($I_b$) of a current supplied from the conductive member and the transfer memory potential ($V_t$) when the photoconductor is a positively charged monolayer type electrophotographic photoconductor.

In FIG. 9, the current density ($I_b$) of a current supplied from the conductive member is plotted as abscissa and the transfer memory potential ($V_t$) as the ordinate.

Here, the transfer memory is removed by the pre-charging means more at the upper part of the ordinate. The transfer memory is removed by the pre-charging means less at the lower part of the ordinate.

The characteristic curves (A) to (D) in FIG. 9 were obtained using conductive brushes having different original filament resistances as the conductive member. Specifically, they were obtained using $1\times10^{12.5}$ (Ω·cm), $1\times10^{10.5}$ (Ω·cm), $1\times10^{8.5}$ (Ω·cm), and $1\times10^{6.5}$ (Ω·cm), respectively.

In the present invention, the transfer memory potential ($V_t$) is defined as a change in surface potential of the surface of the photoconductor at the developing point during continuous printing.

Specifically, it is defined as ($V_1$)-($V_3$) in which provided that a white image is printed while the photoconductor is continuously rotated, ($V_1$) is the surface potential of the surface of the photoconductor at the developing point in the first round and ($V_3$) is the surface potential of the surface of the photoconductor at the developing point in the third round.

As seen from FIG. 9, the residual transfer memory potential is decreased as the current density ($I_b$) is increased regardless of the original filament resistance of the conductive brush. Particularly, it is removed in a stable manner when the current density ($I_b$) is 700 (μA/m$^2$) or above.

Conversely, when the current density ($I_b$) is excessively high, abnormal discharge occurs around the contact area between the conductive brush and the surface of the photoconductor, sometimes causing defective charging.

Consequently, the current density ($I_b$) is preferably set to a value within the range of 700 to 2000 (μA/m$^2$) and more preferably within the range of 1000 to 1500 (μA/m$^2$).

In the present invention, the current density means a current value divided by an area applied per second. In other words, when a current value I (A) is applied to a photoconductor having an axial length L (mm) and rotating at a circumferential velocity D (mm/sec), the current density is I/(L×D) (μA/m$^2$).

Figure 10:
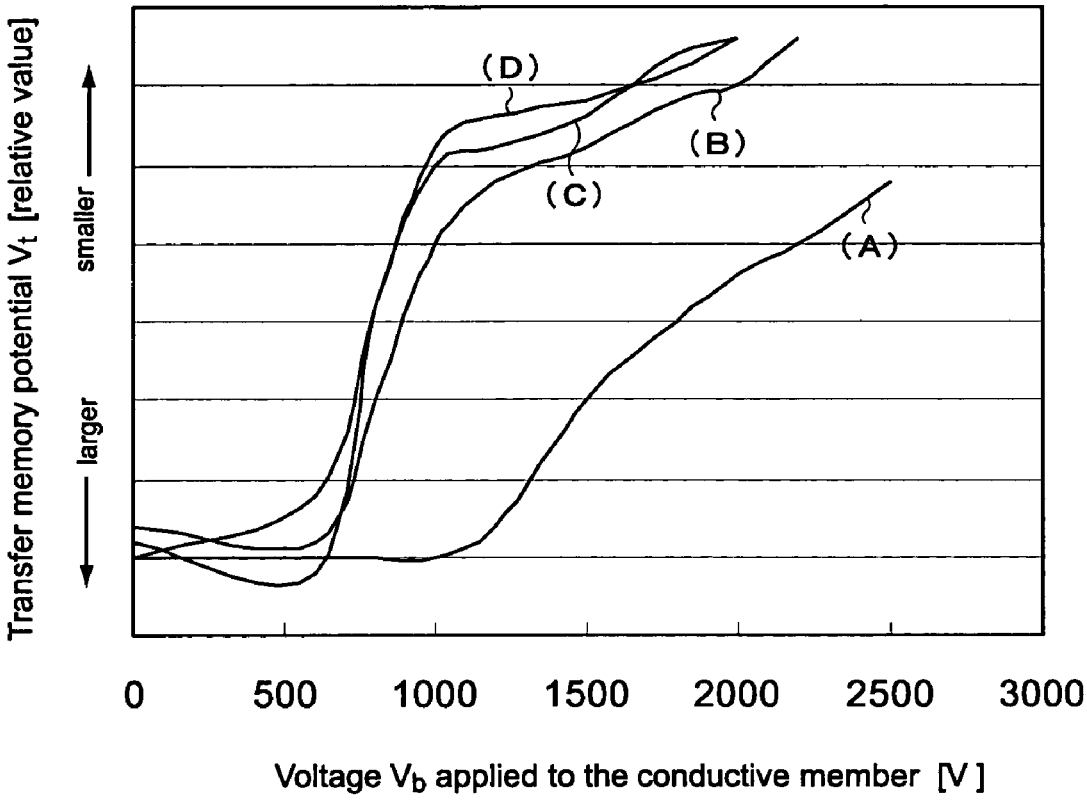
FIG. 10 is a characteristic graph for showing the relationship between the voltage ($V_b$) applied to the conducive member and the transfer memory potential ($V_t$).

FIG. 10 is a graphic representation showing the relationship between the voltage ($V_b$) applied to the conductive member and the transfer memory potential ($V_t$).

In the figure, the voltage ($V_b$) applied to the conductive member is plotted as abscissa and the transfer memory potential ($V_t$) as ordinate. The voltages in FIG. 10 were converted from the current densities ($I_b$) of the characteristic curves (A) to (D) in FIG. 9 using the original filament resistance.

As seen from FIG. 10, higher voltage should be applied to remove the transfer memory as the conductive brush has a higher original filament resistance. Particularly, the removal of the transfer memory is noticeably insufficient for the same applied voltage when the original filament resistance of the conductive brush exceeds $1\times10^{11}$ (Ω·cm).

Therefore, it is preferable that the conductive brush has an original filament resistance of $1\times10^{11}$ (Ω·cm) or below. On the other hand, when the conductive brush has an excessively low original filament resistance, the transfer memory may not be removed completely because of insufficient frictional electrification. Consequently, the original filament resistance is preferably set to a value within the range of $1\times10^{3}$ to $1\times10^{10}$ (Ω·cm) and more preferably within the range of $1\times10^{5}$ to $1\times10^{9}$ (Ω·cm).

Furthermore, the voltage ($V_b$) applied to the conductive member is preferably a direct current voltage of 100 (V) or above. This is because, as shown in FIG. 10, the transfer memory potential ($V_t$) may be reduced regardless of the inherent resistance of the conductive member.

On the other hand, when the applied voltage ($V_b$) is excessively increased, abnormal discharge occurs between the conductive brush and the photoconductive body, sometimes adversely affecting charging.

Consequently, the applied voltage ($V_b$) is preferably set to a value within the range of 1100 to 3000 (V) and more preferably within the range of 1100 to 2000 (V).

Furthermore, the value $|I_b/I_t|$ is preferably 2 or above in which $I_b$ (μA/m$^2$) is the current density of a current supplied from the conductive member and $I_t$ (μA/m$^2$) is the current density of a current supplied from the transferring means.

Figure 11:
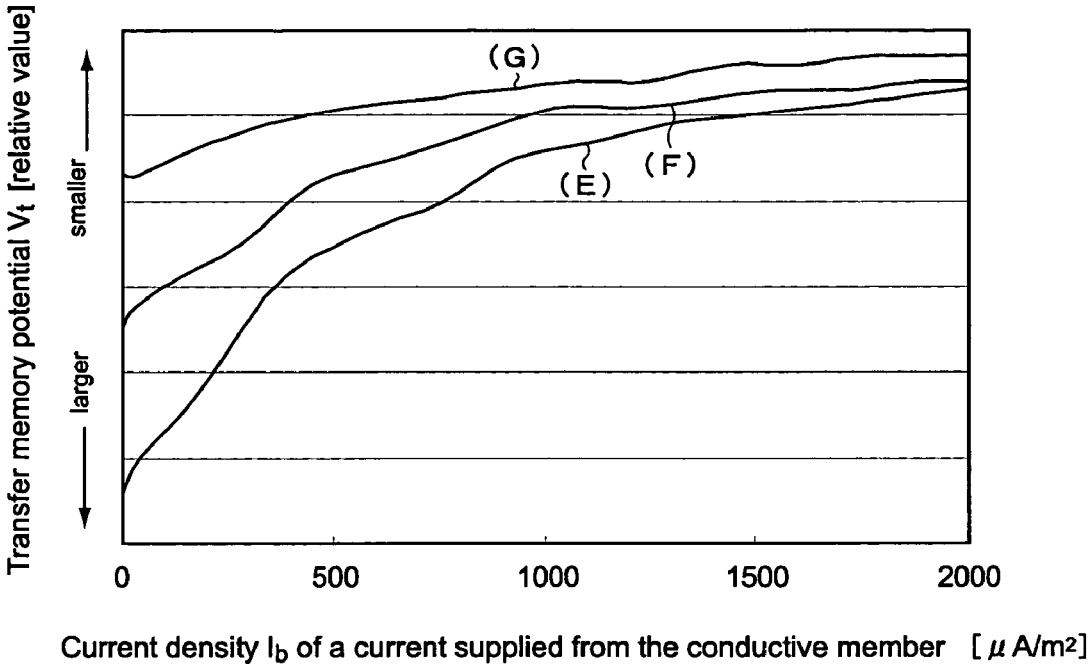
FIG. 11 is a characteristic graph for showing the relationship between the current density ($I_b$) of a current from the transferring means to the surface of the photoconductor and the transfer memory potential ($V_t$).

FIG. 11 is a characteristic graph for showing the relationship between the current density ($I_b$) of a current supplied from the conductive member and the transfer memory potential ($V_t$) for each current density ($I_t$) of a current supplied from the transferring means 15 when a conductive brush having a predetermined original filament resistance is used as the conductive member. The characteristic curves (E) to (G) were obtained when the current density ($I_t$) of a current supplied from the transferring means are −395 (μA/m$^2$), −316 (μA/m$^2$), and −237 (μA/m$^2$), respectively.

Figure 12:
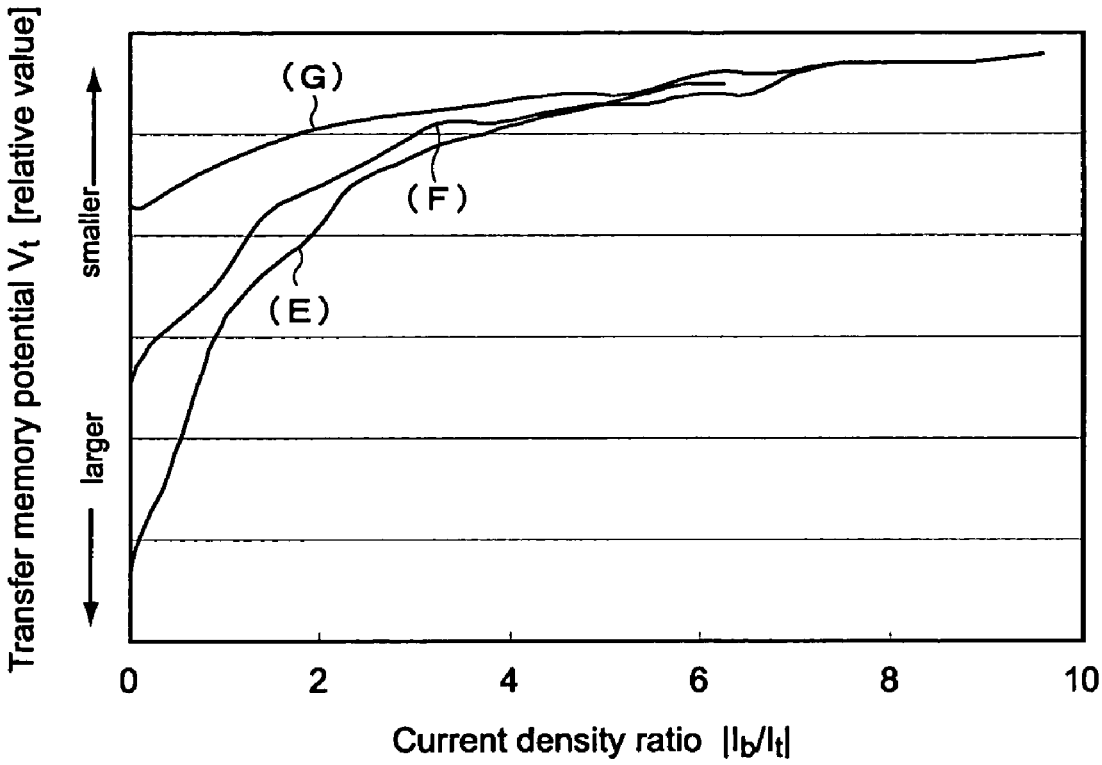
FIG. 12 is a characteristic graph for showing the relationship between the current density ratio $|I_b/I_t|$ and the transfer memory potential ($V_t$).
Figure 13:
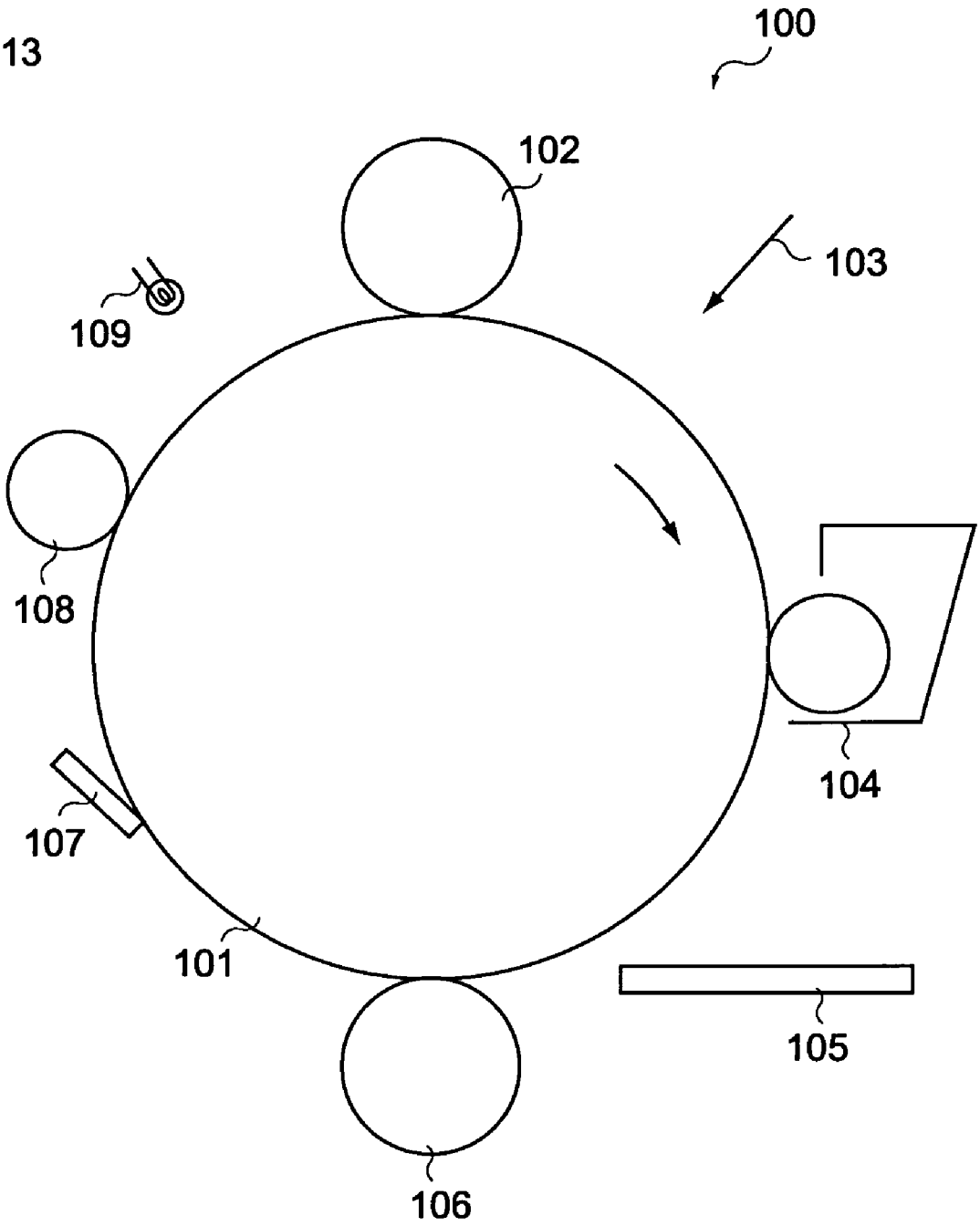
FIG. 13 is a schematic illustration for showing the constitution of a conventional image forming apparatus.

FIG. 12 is a graphical representation showing the characteristic curves of FIG. 11 with $|I_b/I_t|$ as abscissa.

As seen from these characteristic curves, the transfer memory potential ($V_t$) is higher as the absolute value of the current density ($I_t$) of a current supplied from the transferring means is increased. Furthermore, the transfer memory potential ($V_t$) is sufficiently low when the value $|I_b/I_t|$ is 2 or above.

With regard to the characteristic curve (E), the transfer memory potential is low when the absolute value of the current density ($I_b$) of a current supplied from the conductive member is 790 or above. With regard to the characteristic curves (F) and (G), the transfer memory is sufficiently removed when the absolute value of $I_b$ is 632 or above and 474 or above, respectively.

On the other hand, when the current density ($I_b$) is excessively high, abnormal discharge occurs around the contact area between the conductive brush and the surface of the photoconductor, thereby sometimes causing defective charging.

Consequently, the value $|I_b/I_t|$ is preferably set to a value within the range of 2.5 to 8.0 and more preferably within the range of 3.0 to 6.0.

4. Charging Means

It is preferable in the present invention that the charging means for charging the surface of the photoconductor to a predetermined potential be a contact charging means.

This is because, in comparison with non-contact charging means such as corona charging, such a charging means is small-sized and produces no harmful substances such as ozone, which is generated in corona charging, being environmental friendly.

On the other hand, some disadvantages are observed such as wear-out of the surface of the photoconductor and uneven charging in comparison with non-contact charging means. However, using a predetermined conductive member as the contact member, a contact charging means may be employed in the present invention without deteriorating image properties.

Furthermore, it is preferable that the initial charging voltage of the charging means to the monolayer type electrophotographic photoconductor is set to a value of 400 (V) or above.

This is because the initial charging voltage of a predetermined value or above contributes to a desired image density while unevenness in images is reduced in the image forming apparatus of the present invention having an excellent discharging effect, although the transfer memory potential caused by the transferring means is increased.

Furthermore, it is preferable that the portion of the charging means that makes contact with the surface of the photoconductor is made of conductive rubber or conductive sponge.

Specifically, semiconductive polarized rubber (ionic conductive rubber) such as epichlorohydrin rubber and acrylonitrile-butadiene copolymer (NBR), and ionic conductive rubber formed by adding an ionic conductive agent to urethane rubber, acrylic rubber, or silicone rubber to make it semiconductive may be used. Here, the volume resistivity is preferably set to a value within the range of $1\times10^{3}$ to $1\times10^{10}$ (Ω·cm).

Second Embodiment

Another aspect of the present invention is an image forming method using an image forming apparatus including a charging means, a developing means, a transferring means, and a discharging means are arranged in sequence around a monolayer type electrophotographic photoconductor, wherein;

the monolayer type electrophotographic photoconductor is positively charged by the charging means, a pre-charging means having a conductive brush composed of a conductive substrate and conductive brush filaments is provided between the charging means and the discharging means, and the bending ratio (K) of the conductive brush filaments on the surface of the photoconductor satisfies the relational expression (1) below in which a (mm) is the minimum distance between the conductive substrate and the surface of the monolayer type electrophotographic photoconductor and b (mm) is the filament length of the conductive brush filaments.

$$\text{Bending ratio } (K)=(b-a)/b\leqq 0.3 \quad (1)$$

The explanation described in the content of the first embodiment is omitted and the difference between the first embodiments and second embodiment will be mainly described hereinafter.

The image forming apparatus 10 shown in FIG. 2 is preferably used in performing the second embodiment of the present invention.

FIG. 2 is a schematic illustration for showing the entire constitution of the image forming apparatus, of which operation is described hereinafter in sequence.

First of all, the photoconductor 11 of the image forming apparatus 10 is rotated in the arrowed direction A at a predetermined processing speed (circumferential velocity) so that the surface is charged to a predetermined potential by the charging means 12.

Then, the surface of the photoconductor 11 is exposed by the exposure means 13 via a reflecting mirror and the like along with light modulation according to image information. After the exposure, an electrostatic latent image is formed on the surface of the photoconductor 11.

Subsequently, the electrostatic latent image is developed by the developing means 14. In the developing means 14, the toner is contained. Then the toner attaches to the electrostatic latent image formed on the surface of the photoconductor 11, thereby forming a toner image.

Meanwhile, a recording paper 20 is conveyed under the photoconductor along a predetermined transfer/convey route. A predetermined transfer bias is applied between the photoconductor 11 and the transferring means 15, whereby the toner image is transferred to the recording paper 20.

The recording paper 20 to which the toner image is transferred is separated from the surface of the photoconductor 11 by a separation means (not-shown) and conveyed to a stabilizer by a conveyer belt. Then, the toner image is stabilized by the stabilizer through heating and pressuring and discharged outside the image forming apparatus 10 by a discharge roller.

On the other hand, the photoconductor 11 continues to rotate after the toner image is transferred. Residual toner (fouling) that is not transferred to the recording paper 20 during the transfer process is removed from the surface of the photoconductor 11 by the cleaning device 17 of the present invention. Residual charges on the surface of the photoconductor 11 is removed by the pre-charging means 2 and completely eliminated by discharging light emitted from a discharger 18. Then, it is ready for the next image.

In the image forming apparatus of the present invention, a current having a predetermined range of current densities is supplied to the surface of the photoconductor from the pre-charging means to remove the transfer memory, thereby exhibiting excellent discharging effect.

EXAMPLE

Example 1

1. Constitution of an Electrophotographic Photoconductor 2.7 part by weight of X-type non-metallic phthalocyanin as a charge generation agent, 50 part by weight of stilbenamine compound as an hole transfer agent, 35 part by weight of azoquinone compound as an electron transfer agent, 100 part by weight of bisphenol Z-type polycarbonate resin as a binding resin, and 700 part by weight of tetrahydrofuran were introduced into a vessel with stirrer, mixed and dispersed by using a ball mill for 50 hours to prepare a coating solution. Then, a conductive support made of an almite-treated aluminum duct was applied with the obtained coating solution and dried with hot-air at 130° C. for 45 minutes to obtain a monolayer type electrophotographic photoconductor having a coating thickness of 30 μm and a diameter of 30 mm.

2. Constitution of a Conductive Member

A conductive polyamide brush (having a single filament fineness of 6.2 (denier), a filament length of 3 mm, and an original filament resistance of $1\times10^{8.5}$ (Ω·cm)) was used as the conductive member.

3. Evaluation (1) Evaluation for the Appearance of White Streaks

The obtained photoconductor was mounted in a modified printer KM1500 manufactured by Kyocera Mita Corporation. The conductive member was pressed against the surface of the photoconductor to set a nip width to 5 mm and a bending ratio to 0.06 (the bending quantity (the difference (b−a) between the conductive brush filament length b (mm) and the minimum distance a (mm)) was 0.18 (mm)).

Then, the photoconductor was rotated at a circumferential velocity of 110 (mm/sec). Furthermore, a direct current voltage of 1200 (V) was applied between the surface of photoconductor and the conductive member to charge the surface of photoconductor to set to approximately 400 (V).

Then, a direct current was applied between the transferring means and the surface of the photoconductor so that the transferring means could be supplied a current having a current density of −237 (μA/m$^2$) (equivalent to a current of −6 (μA)).

Then, a voltage of 1000 (V) was applied to the pre-charging means and a recording paper was introduced to print a gray image. By counting white streaks per 10 (cm) in the drum axial direction, the obtained gray image was evaluated according to the criteria below. The results are shown in Table 1.

+: no white streaks appear

±: one or less streak appears

−: two or more streaks appear (2) Evaluation for the Transfer Memory

The transfer memory potential was measured while a gray image was printed under the same conditions as used for the evaluation for white streaks described above.

+: the absolute value which the transfer memory potential is less than 5;

±: the absolute value which the transfer memory potential is not less than 5 and less than 8

−: the absolute value which the transfer memory potential is not less than 8.

TABLE 1

| | Conductive brush | | | Evaluation result | | |
|---|---|---|---|---|---|---|
| | | | | Transfer | White streaks | |
| | Filament length (mm) | Bending quantity (mm) | Bending ratio (−) | memory potential | (Number/width 10 cm) | Result |
| Example 1 | 3 | 0.18 | 0.060 | + | 0 | + |
| Example 2 | 3 | 0.36 | 0.120 | + | 0 | + |
| Example 3 | 3 | 0.54 | 0.180 | + | 0 | + |
| Example 4 | 3 | 0.72 | 0.240 | + | 0 | + |
| Example 5 | 3 | 0.90 | 0.300 | + | 1 | ± |
| Comparative Example 1 | 3 | 1.08 | 0.360 | + | 3 | − |
| Comparative Example 2 | 3 | 1.26 | 0.420 | + | 6 | − |

Examples 2 to 5

In Examples 2 to 5, an electrophotographic photoconductor and a conductive brushes were constituted and evaluated under the same conditions as those of Example 1 except for the bending ratio being 0.12 to 0.30. The results are shown in Table 1.

Comparative Examples 1 and 2

In Comparative Examples 1 and 2, an electrophotographic photoconductor and a conductive brushes were constituted and evaluated under the same conditions as those of Example 1 except for the bending ratio being 0.36 and 0.42. The results are shown in Table 1.

Examples 6 to 13

In Examples 6 to 13, an electrophotographic photoconductor and a conductive brushes were constituted and evaluated under the same conditions as those of Example 1 except for the filament length being 5 (mm) and the bending ratio being 0.32 to 0.284. The results are shown in Table 2.

TABLE 2

| | Conductive brush | | | Evaluation result | | |
|---|---|---|---|---|---|---|
| | | | | Transfer | White streaks | |
| | Filament length (mm) | Bending quantity (mm) | Bending ratio (–) | memory potential | (Number/width 10 cm) | Result |
| Example 6 | 5 | 0.16 | 0.032 | + | 0 | + |
| Example 7 | 5 | 0.34 | 0.068 | + | 0 | + |
| Example 8 | 5 | 0.52 | 0.104 | + | 0 | + |
| Example 9 | 5 | 0.70 | 0.140 | + | 0 | + |
| Example 10 | 5 | 0.88 | 0.176 | + | 0 | + |
| Example 11 | 5 | 1.06 | 0.212 | + | 0 | + |
| Example 12 | 5 | 1.24 | 0.248 | + | 0 | + |
| Example 13 | 5 | 1.42 | 0.284 | + | 0 | + |
| Comparative Example 3 | 5 | 1.60 | 0.320 | + | 2 | – |
| Comparative Example 4 | 5 | 1.78 | 0.356 | + | 3 | – |
| Comparative Example 5 | 5 | 2.14 | 0.428 | + | 6 | – |

Comparative Examples 3 to 5

In Comparative Examples 3 to 5, a electrophotographic photoconductor and conductive brushes were constituted and evaluated under the same conditions as those of Example 1 except for the filament length being 5 (mm) and the bending ratio being 0.320 to 0.428. The results are shown in Table 2.

As seen from Tables 1 and 2, Examples 1 to 13 in which the proper conditions as the present invention were applied to the pre-charging means result in the excellent charging property and image evaluation.

In Comparative Examples 1 to 5 in which the bending ratio were excessively high, abnormal discharge generated between the conductive blush filaments and the surface of the photoconductor, and white streaks appeared, while the transfer memory potentials were high and image properties were deteriorated.

Example 14

In Example 14, the conductive brush filaments were conductive polyamide filaments having a single filament fineness of 30 (denier) (450T/15F), a length of 3 (mm), and an original filament resistance of $1\times10^{8.5}$ (Ω·cm). The conductive polyamide filaments were woven into a fabric of the same filaments to prepare a brush having a filament density of 100 (kilo-filaments/inch$^2$).

Then, the brush was bonded to a conductive substrate made of a stainless plate using a double-faced conductive tape to produce a conductive brush. The brush was evaluated in a modified printer KM1500 manufactured by Kyocera Mita Corporation in the same manner as in Example 1.

In Example 14, the bending ratio defined by the relation expression (1) was 0.06.

Examples 15 to 18

In Examples 15 to 18, an electrophotographic photoconductor and conductive brushes were produced and evaluated under the same conditions as those of Example 14 except for the conductive brush filaments having a single filament fineness of 6 (denier) or above in place of 30 (denier) in Example 14 as shown in Table 3. The results are shown in Table 3.

Comparative Examples 6 and 7

In Comparative Examples 6 and 7, an electrophotographic photoconductor and conductive brushes were produced and evaluated under the same conditions as those of Example 14 except for the conductive brush filaments having a single filament fineness of less than 6 (denier) in place of 30 (denier) in Example 14 as shown in Table 3. The results are shown in Table 3.

TABLE 3

| | | Transfer memory | | |
|---|---|---|---|---|
| | Single filament fineness (denier) | Transfer memory potential (V) | Evaluation | White streaks (number/10 cm) |
| Example 14 | 30.0 | 4 | + | 0 |
| Example 15 | 11.7 | 3 | + | 0 |
| Example 16 | 11.0 | 4 | + | 0 |
| Example 17 | 6.9 | 4 | + | 0 |
| Example 18 | 6.6 | 4 | + | 0 |
| Comparative Example 6 | 2.3 | 4 | + | 4 |
| Comparative Example 7 | 1.4 | 4 | + | 11 |

As seen from the results shown in Table 3, in Examples 14 to 18 in which the conductive brush has conductive brush filaments having a single filament fineness of 6 (denier) or above, abnormal discharge was prevented and no white streaks were observed in a gray image.

On the other hand, in Comparative Examples 6 and 7 in which the conductive brush has conductive brush filaments having a single filament fineness of less than 6 (denier), abnormal discharge was not sufficiently prevented and white streaks were observed in a gray image.

Example 19

In Example 19, the conductive brush filaments were conductive polyamide filaments having a single filament fineness of 30 (denier) (450T/15F), a length of 3 (mm), and an original filament resistance of $1\times10^{8.5}$ (Ω·cm). The conductive polyamide filaments were woven into a fabric of the same filaments to prepare a brush having a filament density of 70 (kilo-filament/inch$^2$).

Then, the brush was bonded to a conductive substrate made of a stainless plate using a double-faced conductive tape to produce a conductive brush. The brush was evaluated in a modified printer KM1500 manufactured by Kyocera Mita Corporation in the same manner as in Example 1.

In Example 19, the bending ratio defined by the relational expression (1) was 0.06.

Examples 20 to 22

In Examples 20 to 22, electrophotographic photoconductors and conductive brushes were produced and evaluated under the same conditions as those of Example 19 except for the conductive brush having a filament density of 180 (kilo-filaments/inch$^2$) or below in place of 70 (kilo-filaments/inch$^2$) in Example 19 as shown in Table 4. The results are shown in Table 4.

Comparative Examples 8 to 10

In Comparative Examples 8 to 10, an electrophotographic photoconductor and conductive brushes were produced and evaluated under the same conditions as those of Example 19 except for the conductive brush having a filament density of higher than 180 (kilo-filaments/inch$^2$) in place of 70 (kilo-filaments/inch$^2$) in Example 19 as shown in Table 4. The results are shown in Table 4.

TABLE 4

| | Filament density (kilo-filaments/inch$^2$) | Transfer memory | | White |
|---|---|---|---|---|
| | | Transfer memory potential (V) | Evaluation | streaks (number/10 cm) |
| Example 19 | 70 | 4 | + | 0 |
| Example 20 | 100 | 4 | + | 0 |
| Example 21 | 120 | 4 | + | 0 |
| Example 22 | 180 | 4 | + | 0 |
| Comparative Example 8 | 240 | 4 | + | 1 |
| Comparative Example 9 | 320 | 3 | + | 3 |
| Comparative Example 10 | 430 | 4 | + | 12 |

As seen from the results shown in Table 4, in Example 19 to 22 in which the conductive brush has a filament density of 180 (kilo-filaments/inch$^2$) or below, abnormal discharge was prevented and no white streaks were observed in a gray image.

On the other hand, in Comparative Examples 8 to 10 in which the conductive brush has a filament density of higher than 180 (kilo-filaments/inch$^2$), abnormal discharge was not sufficiently prevented and white streaks were observed in a gray image

INDUSTRIAL APPLICABILITY

According to an image forming apparatus and an image forming method using the same in the present invention, a conductive brush for removing the transfer memory is arranged around a photoconductor so that the conductive substrate and the surface of the photoconductor satisfy a predetermined positional relationship, whereby abnormal discharge generating between the conductive brush filaments and the surface of the photoconductor is prevented and white streaks in a gray image are reduced.

According to the another aspect of the image forming apparatus and another image forming method using the same in the present invention, a conductive brush with conductive brush filaments having a single filament fineness within a predetermined range is used, whereby white streaks in a gray image may be reduced.

According to yet another aspect of the image forming apparatus and another image forming method using the same in the present invention, a conductive brush having a filament density within a predetermined range is used, whereby white streaks in a gray image may be reduced.

Consequently, the image forming apparatus and the image forming method using the same in the present invention are expected to contribute to high image quality, low power consumption, and down-sizing in an image forming apparatus, respectively.

What is claimed is:

1. An image forming apparatus including a charging means, a developing means, a transferring means, a cleaning means, and a discharging means which are arranged in sequence around a monolayer type electrophotographic photoconductor, wherein;

the charging means is a means for positively charging the surface of the monolayer type electrophotographic photoconductor, a pre-charging means having a conductive brush composed of a conductive substrate and conductive brush filaments, is arranged between the cleaning means and the discharging means, and the bending ratio (K) of the conductive brush filaments on the surface of the photoconductor satisfies the following relational expression (1) in which a (mm) is the minimum distance between the conductive substrate and the surface of the monolayer type electrophotographic photoconductor and b (mm) is the filament length of the conductive brush filaments:

$$\text{Bending ratio } (K)=(b-a)/b \leqq 0.18 \quad (1).$$

2. An image forming apparatus including a charging means, a developing means, a transferring means, a cleaning means, and a discharging means which are arranged in sequence around a monolayer type electrophotographic photoconductor, wherein;

the charging means is a means for positively charging the surface of the monolayer type electrophotographic photoconductor, a pre-charging means having a conductive brush is arranged between the cleaning means and the discharging means, the conductive brush is in contact with the surface of the monolayer type electrophotographic photoconductor, and the conductive brush has the conductive brush filaments having a single filament fineness of 6 (denier) or above.

3. An image forming apparatus including a charging means, a developing means, a transferring means, a cleaning means, and a discharging means which are arranged in sequence around a monolayer type electrophotographic photoconductor, wherein;

the charging means is the means for positively charging the surface of the monolayer type electrophotographic photoconductor, a pre-charging means having a conductive brush is arranged between the cleaning means and the discharging means, the conductive brush is in contact with the surface of the monolayer type electrophotographic photoconductor, and the conductive brush has a filament density of 180 (kilo-filaments/inch$^2$) or below.

4. The image forming apparatus according to claim 1, wherein the difference (b−a) between the conductive brush filament length b (mm) and the minimum distance a (mm) is set to a value within the range of 0.01 to 1.0 (mm).

5. The image forming apparatus according to claim 1, wherein conductive brush filaments are made of a polyamide resin or a polyester resin containing conductive particles.

6. The image forming apparatus according to claim 1, wherein the conductive brush filaments have an original filament volume resistivity set to a value of $1\times10^{11}$ (Ω·cm) or below.

7. The image forming apparatus according to claim 1, wherein the conductive brush filaments are woven into a conductive fabric and the brush filaments-woven conductive fabric is attached to a conductive substrate.

8. The image forming apparatus according to claim 1, wherein the conductive substrate is a stainless plate.

9. The image forming apparatus according to claim 1, wherein the charging means is a contact charging system.

10. The image forming apparatus according to claim 1, wherein the initial charging voltage by the charging means to the monolayer type electrophotographic photoconductor is set to a value of 400 (V) or above.

11. An image forming method using an image forming apparatus including a charging means, a developing means, a transferring means, a cleaning means, and a discharging means which are arranged in sequence around a monolayer type electrophotographic photoconductor, wherein;

the monolayer type electrophotographic photoconductor is positively charged by the charging means, a pre-charging means having a conductive brush composed of a conductive substrate and conductive brush filaments is arranged between the cleaning means and the discharging means, and the bending ratio (K) of the conductive brush filaments on the surface of the electrophotographic photoconductor satisfies the following relational expression (1) in which a (mm) is the distance between the conductive substrate and the surface of the monolayer type electrophotographic photoconductor and b (mm) is the filament length of the conductive brush filaments:

$$\text{Bending ratio } (K)=(b-a)/b\leqq 0.18 \quad (1).$$

* * * * *